US007445486B2

(12) United States Patent
Shen et al.

(10) Patent No.: US 7,445,486 B2
(45) Date of Patent: Nov. 4, 2008

(54) ELECTRICAL CONNECTOR WITH IMPROVED LATCHING DEVICES

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/011,060

(22) Filed: Jan. 23, 2008

(65) Prior Publication Data

US 2008/0176441 A1 Jul. 24, 2008

(30) Foreign Application Priority Data

Jan. 23, 2007 (CN) ..... 2007 1 0019622

(51) Int. Cl.
*H01R 13/627* (2006.01)

(52) U.S. Cl. ..... 439/353

(58) Field of Classification Search ..... 439/352, 439/358, 350, 353, 939, 326
See application file for complete search history.

(56) References Cited

U.S. PATENT DOCUMENTS 5,797,771 A * 8/1998 Garside ..... 439/610
6,132,231 A * 10/2000 Suzuki ..... 439/352
6,152,754 A * 11/2000 Gerhardt et al. ..... 439/325
6,957,976 B2 * 10/2005 Zhang ..... 439/358
6,988,908 B2 * 1/2006 Zhang et al. ..... 439/358
7,025,620 B2 * 4/2006 Li et al. ..... 439/358
7,147,505 B2 12/2006 Li et al.

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector (100) includes a connector member (1) providing a plurality of conductive terminals (10) therein, an insulative coat (3) defining a receiving cavity (30) with an opening and a pair of through holes (32) provided at opposite sides of the receiving cavity, a pair of latching members received in the receiving cavity with a front hook portion extending out of the opening, and a pair of press members (4). The connector member includes a base portion (18) received in the receiving cavity (30) and a mating portion (14) extending forward from the base portion and out of the opening. The press members are assembled into the through hole and are retained with a back portion of the latching member.

12 Claims, 8 Drawing Sheets

ELECTRICAL CONNECTOR WITH IMPROVED LATCHING DEVICES

BACKGROUND OF THE INVENTION

1. Field of the invention

The present invention relates to an electrical connector, and more particularly to an electrical connector with a pair of latching devices for locking/unlocking with a complementary connector.

2. Description of Related Art

U.S. Pat. No. 7,147,505 discloses a conventional electrical connector for connecting with a cable. The connector includes a connector member providing a plurality of conductive contacts therein, a cable electrically connecting with the connector member at one end, a pair of upper and lower metal shells attached together so as to form a box room to receive one end of the cable and connector member. A pair of separate metal latching members, used for locking with a complementary connector, are mounted onto the metal shells. An insulating coat surrounds the shells and provides with a hole for allowing a finger of a user to press an back end of the latching member to release the engagement of the latching member and the complementary connector. A inwardly bend portion from the back end of the latching member is provided as a fulcrum while the latching member acting.

However, the bend portion may loose elasticity and even can not work as a fulcrum any more during the latching members continually being pressed, which will make a disengagement of the latching member and the complementary connector.

Hence, an improved electrical connector is desired to overcome above problem.

SUMMARY OF THE INVENTION

An object of the present invention is to provide an electrical connector comprising a pair of locking members for locking with a complementary connector and a pair of press members to release the locking members from the complementary connector. The press member is reliably and easily retained with the locking member.

In order to achieve above-mentioned object, an electrical connector includes a connector member providing a plurality of conductive terminals therein, an insulative coat defining a receiving cavity with an opening and a pair of through holes provided at opposite sides of the receiving cavity, a pair of latching members received in the receiving cavity with a front hook portion extending out of the opening, and a pair of press members. The connector member includes a base portion received in the receiving cavity and a mating portion extending forward from the base portion and out of the opening. The press members are assembled into the through hole and are retained with a back portion of the latching member.

Other objects, advantages and novel features of the present invention will become more apparent from the following detailed description of the present embodiment when taken in conjunction with the accompanying drawings.

DETAILED DESCRIPTION OF THE INVENTION

Figure 1:
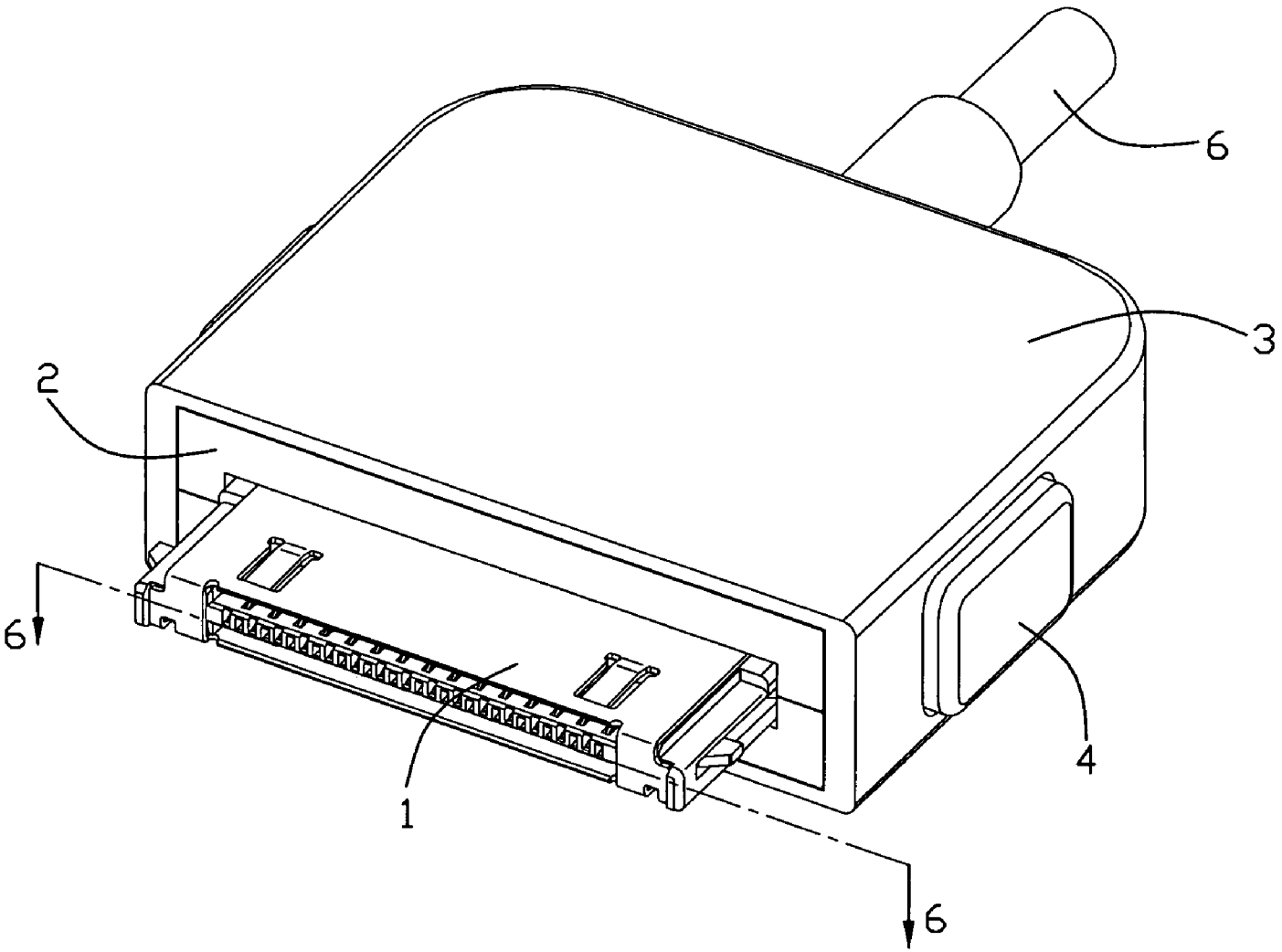
FIG. 1 is a front assembled perspective view of an electrical connector in accordance with the present invention.

Reference will now be made to the drawing figures to describe the preferred embodiment of the present invention in detail.

Figure 2:
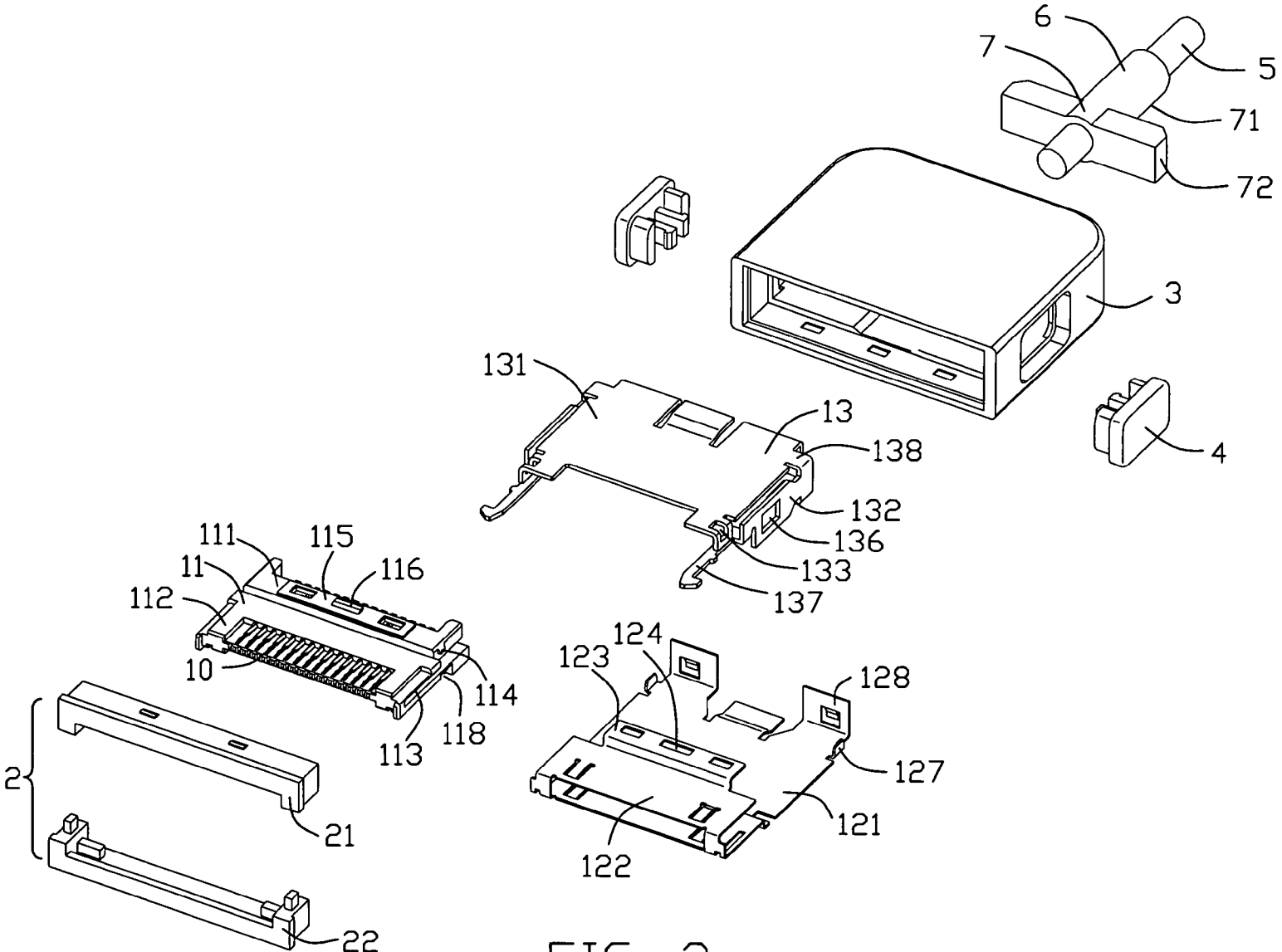
FIG. 2 is an exploded perspective view of the electrical connector of FIG. 1.

Referring to FIGS. 1 and 2, an electrical connector 100 in accordance with the present invention mainly comprises a connector member 1 mating with a complementary connector (not shown), a retaining member 2, an insulative coat 3, a pair of press members 4, and a cable assembly 6. The connector member 1 comprises an insulative housing 11 providing a plurality of conductive terminals 10 therein, a first shell 12, and a second shell 13.

As shown in FIG. 2, the insulative housing 11 comprises a base portion 111, a mating portion 112 extending forward from the base portion 111, and a plurality of receiving grooves (not labeled) running through the base portion 111 and the mating portion 112 to receive the conductive terminals 10. The base portion 111 defines a protrusion 114 at each end thereof and an engaging portion 115 on the top surface of the base portion 111. The engaging portion 115 comprises a protrude portion 116 and two recesses 117 at one side of the protrude portion 116. A slot 113 is provided at each end of the mating portion 112 and runs through the base portion 111. The first shell 12 comprises a first flat portion 121 and a second flat portion 122 parallel to the first flat portion 121 and connecting the first flat portion 121 at front ends. The second flat portion 122 further extends rearward to provide a retaining portion 123. The first shell 12 are assembled on the housing 11 with the first flat portion 121 on the bottom of the housing 11 and the second flat portion 122 on the top of the housing 12. The front of the first shell 12 surrounds the mating portion 112 with a retaining holes 124 of the retaining portion 123 engaging with the protrude portion 116 of the engaging portion 115. Locking portions 127, 128 extend from the first shell 12 at opposite sides and a rear edge of the first flat portion 121 and each locking portion 128 provides an outshoot.

Figure 3:
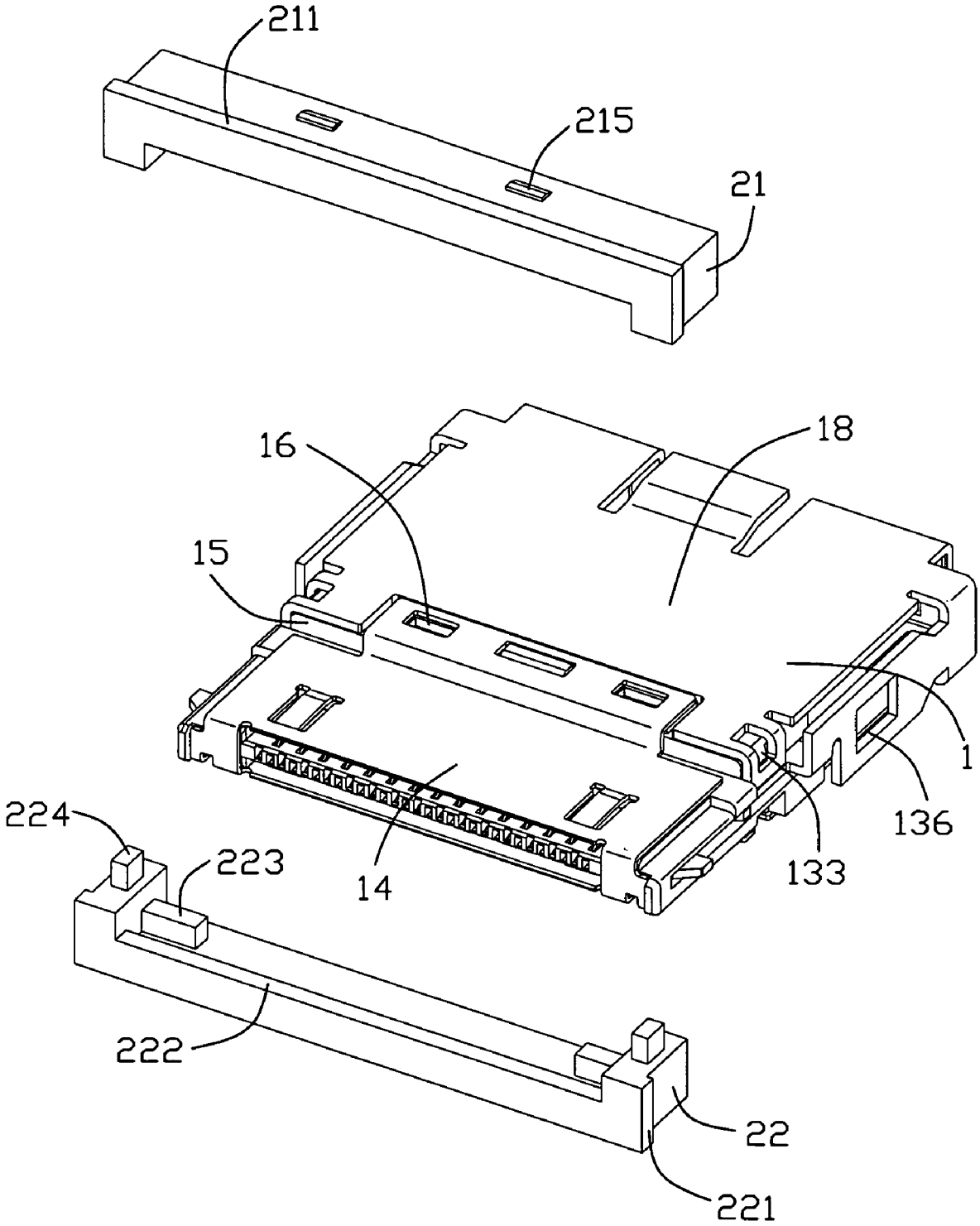
FIG. 3 is a perspective view of the assembled connector member.

The second shell 13 comprises a third flat portion 131 and a pair of sidewalls 132 vertical and connecting to the third flat portion 131 at rear portion with a connection portion 138. A latching arm 137 with a distal hook at free end thereof parallelly extends forward from the front edge of each sidewall 132, and a through hole 136 is defined in the center of each sidewall. Each sidewall 132 with the latching arm 137 is provided as a latching member. The second shell 13 covers the housing 11 with the third flat portion 131 on the top of the base portion 111. A through hole 133 locks with the protrusion 114 (see FIG. 3) and locking portions 134, 135 are engaged with the corresponding locking portions 127, 128 (see FIG. 4). The latching arms 137 are received in the slots 113. Therefore the assembled connector member 1 as shown in FIG. 3 is provided. See FIGS. 3 and 4, The connector member 1 comprises a base portion 18 and a mating portion 14 extending forward from the base portion 18. The mating portion 14 is thinner than the base portion 18 so as to provide a stopper portion 15 thereof. Two recesses 16 are defined on the top of the base portion 18, and a slot 17 is on the bottom of the base portion 18. The shells 12, 13 are longer than the base portion 111 of the housing 11 for providing a room in the rear portion thereof to shield metal cores of the cable 5 connecting with the terminal 10.

Figure 4:
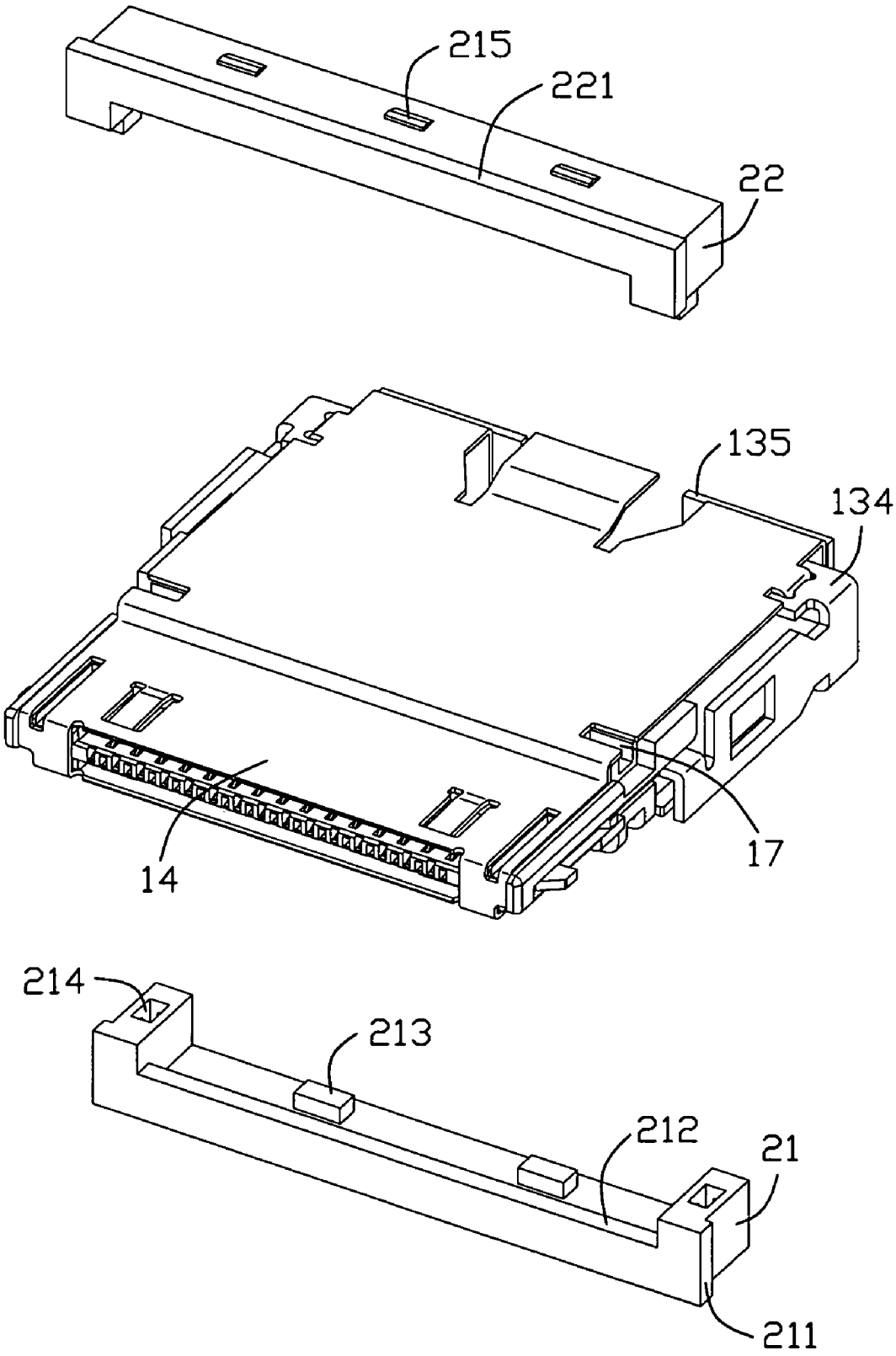
FIG. 4 is another view of the assembled connector member of FIG. 3.

As shown in FIGS. 3 and 4, the retaining member 2 is made of insulative material and has two corresponding longitudinal ⊓shaped members, a first portion 21 and a second portion 22. The two portions are put on the base portion 18 of the connector member 1 to sandwich it. Protrusions 213, 223 in the inside of first and second portions 21, 22 are respective received and retained in the hole 16 and slot 17. And protrusions 224 on the opposite ends of the second portion 22 are inserted into and retained in corresponding holes 214 at the opposite ends of the first portion 21. The step portions 212, 222 of the first and second portion 21, 22 are encountered with the stopper portion 15 of the connector member 1. As FIG. 5 shown, the retaining member 2 retains the connector member 1 steadily, the mating portion 14 runs out of the retaining member 2 in the front, and the back portion of the connector member 1 exposes to the back of the retaining member 2.

Figure 5:
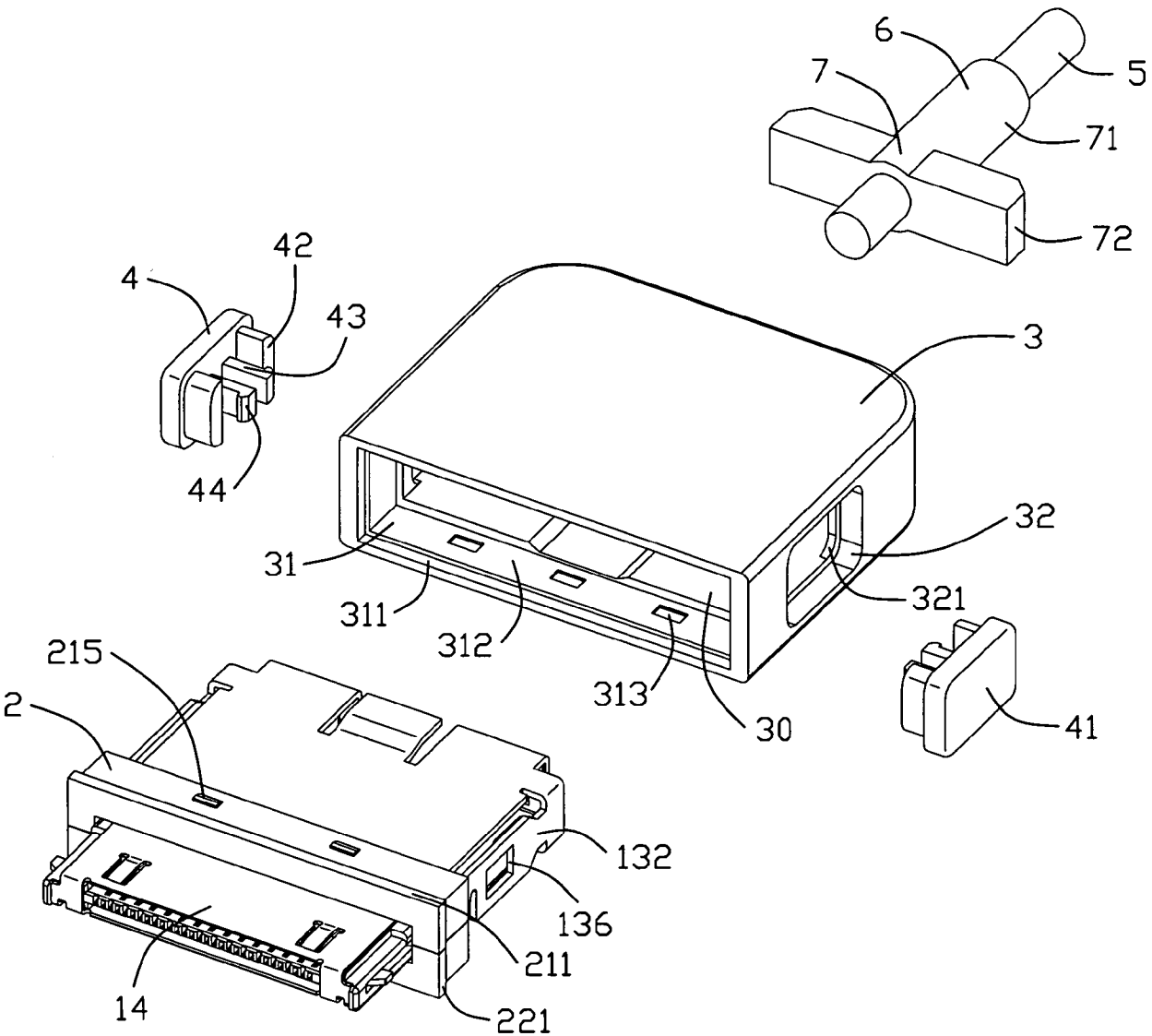
FIG. 5 is a partly-assembled perspective view of the electrical connector.
Figure 6:
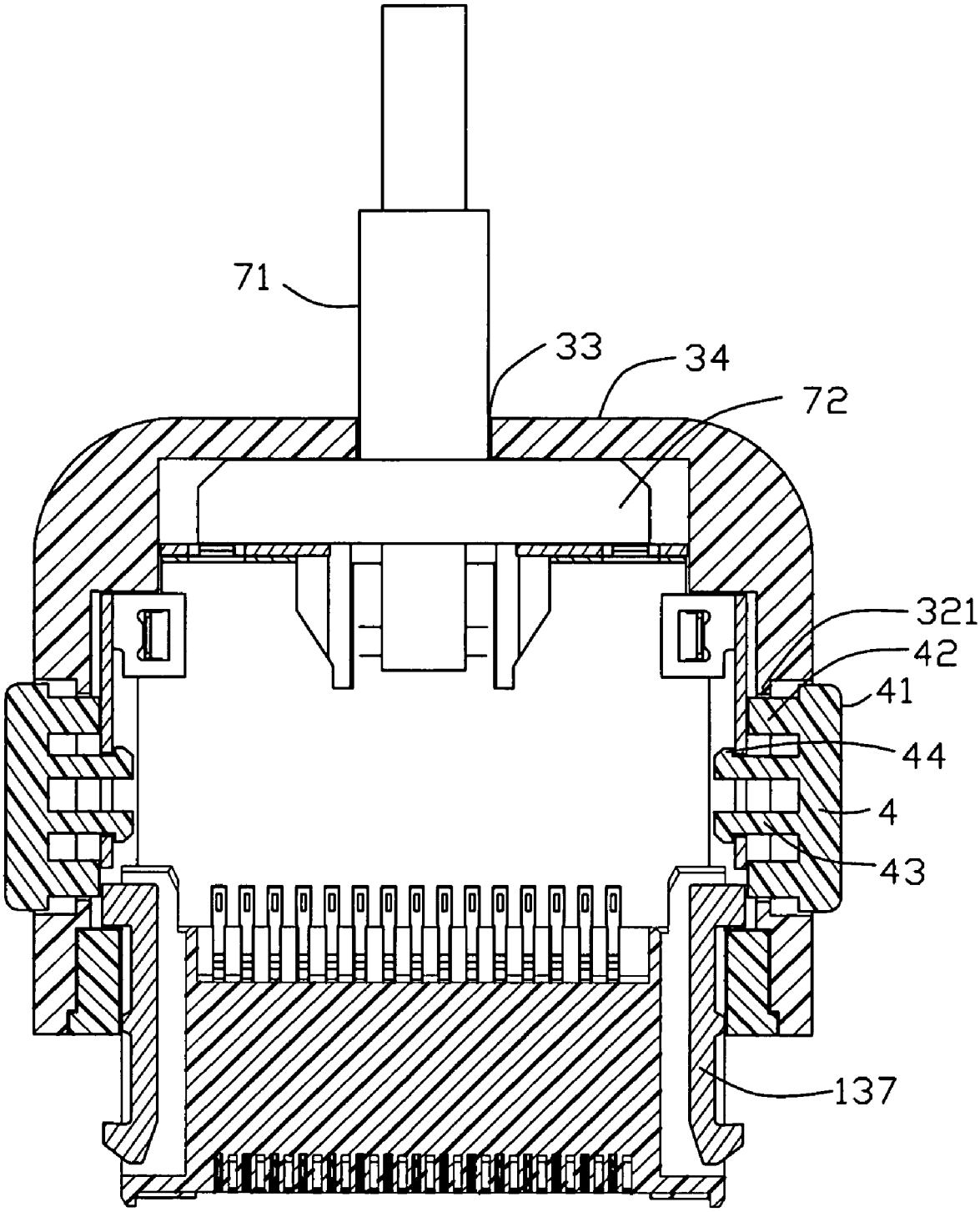
FIG. 6 is a cross-sectional view of FIG. 1 taken along line 6-6.

Referring to FIGS. 5 and 6, the single-piece insulative coat 3 defines a receiving cavity 30 therein with an opening. The assembled connector member 1 with the retaining member 2 is inserted into the cavity 30 from the opening. The cavity 30 provides an installation space 31 for receiving the retaining member 2 at the front portion thereof. The installation space 31 comprises a first portion 311 and a smaller second portion 312 with different size to define two step faces, which are provided to encounter outside block portions 211, 221 and the rear portion of the retaining member 2 to prevent the retaining member 2 from further entering into the cavity 30. A plurality of recesses 313 are provided to lock with corresponding protrusions 215.

See FIGS. 5 and 6, the insulative coat 3 provides an installation hole 32 with a stopper 321 in each sidewall. The press member 4 comprises an operating portion 41, two contacting portions 42 extending inward from opposite ends of the operating portion 41, and two locking portions 43 extending inward between the two contacting portions 42. The two locking portions 43 are parallel to each other and each provides with a hook portion 44 at the free end. The locking portion 43 is longer than the contacting portion 42.

The press member 4 is assembled into the coat 3 from the installation hole 32. The hook portion 44 of the locking portion 43 hook the edges of the through hole 136 of the sidewall 132 for retaining the press member 4 with the second shell 13. The contacting portions 42 press against the sidewall 132 beside the through hole 136. The contacting portion 42 may push the sidewall 132 inward when a exterior force is exerted on the operating portion 41, which will result in the latching arm 137 inwardly moving to release the complementary connector. The inside edge of the operating portion 41 may be stopped by stopper 321 so as to prevent the press member 4 from moving overly.

The coat 3 defines a cable outlet 33 at middle portion of a rear wall 34. The cable assembly 6 comprises a cable 5 and a strain relief member 7 circumferentially fixed on the cable 5. The strain relief member 7 comprises a block member 72 and a boot portion 71 integrally extending reward from the block member 72. The cable outlet 33 is configured to be generally similar shape and size as the boot portion 71 for making the boot portion 71 just passing through. Generally, the insulative coat 3 is assembled in the front-to-rear direction after the cable 5, the connector member 1 and the retaining member 2 are all completely assembled together. The block member 72 of the strain relief member 7 blocks the insulative coat 3 to be assembled in an accurate position avoiding excessive assembly. The boot portion 71 passes through the cable outlet 33 and other parts are meanwhile encased in the receiving cavity 30 except the mating portion 14 for mating with the complementary element, the retaining member 2 is fixed in the installation space 31 by the protrusions 215 engaging with the concaves 313.

Figure 7:
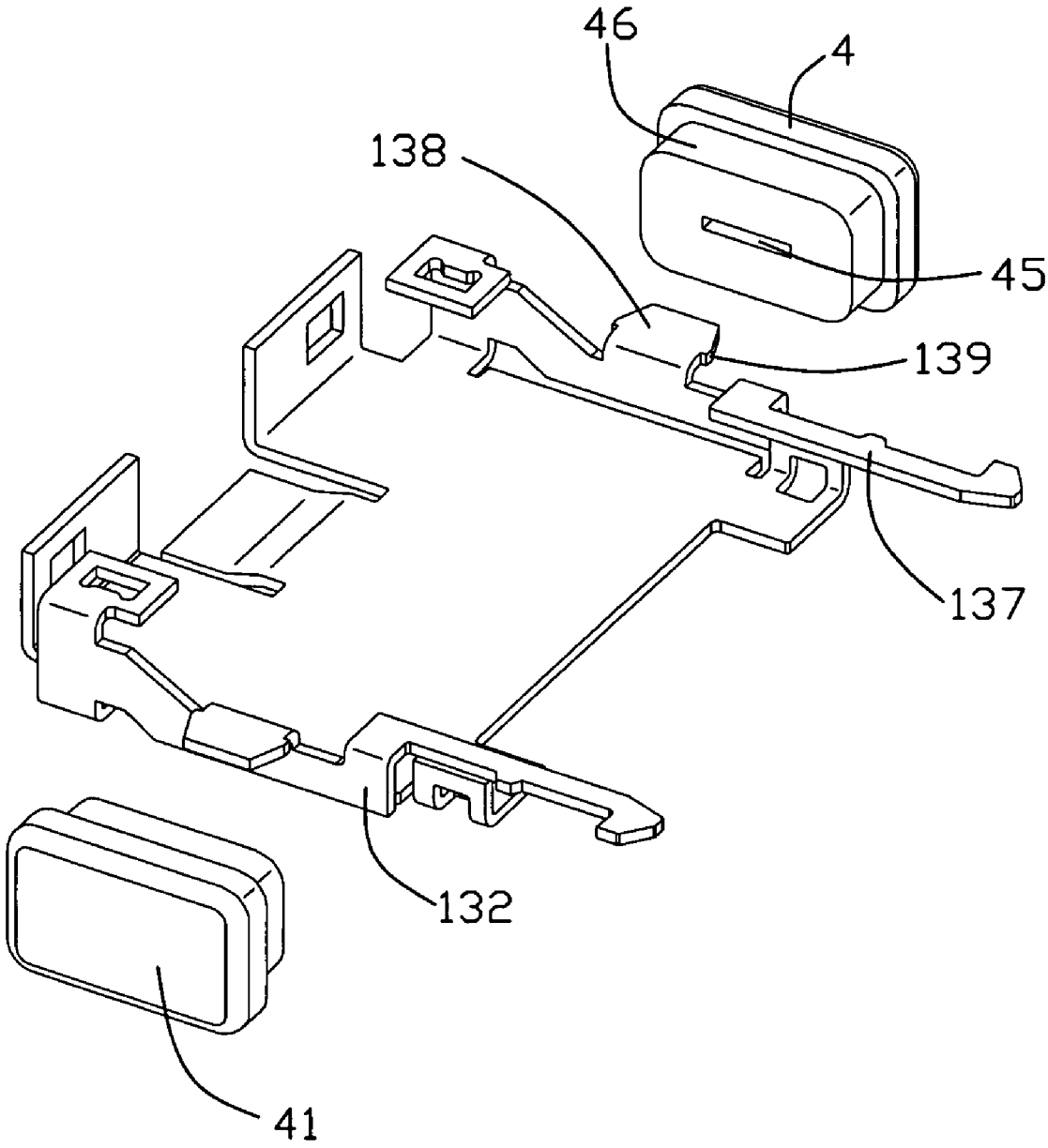
FIG. 7 is an exploded perspective view of the press members and the second shell in accordance with a second embodiment of the present invention.
Figure 8:
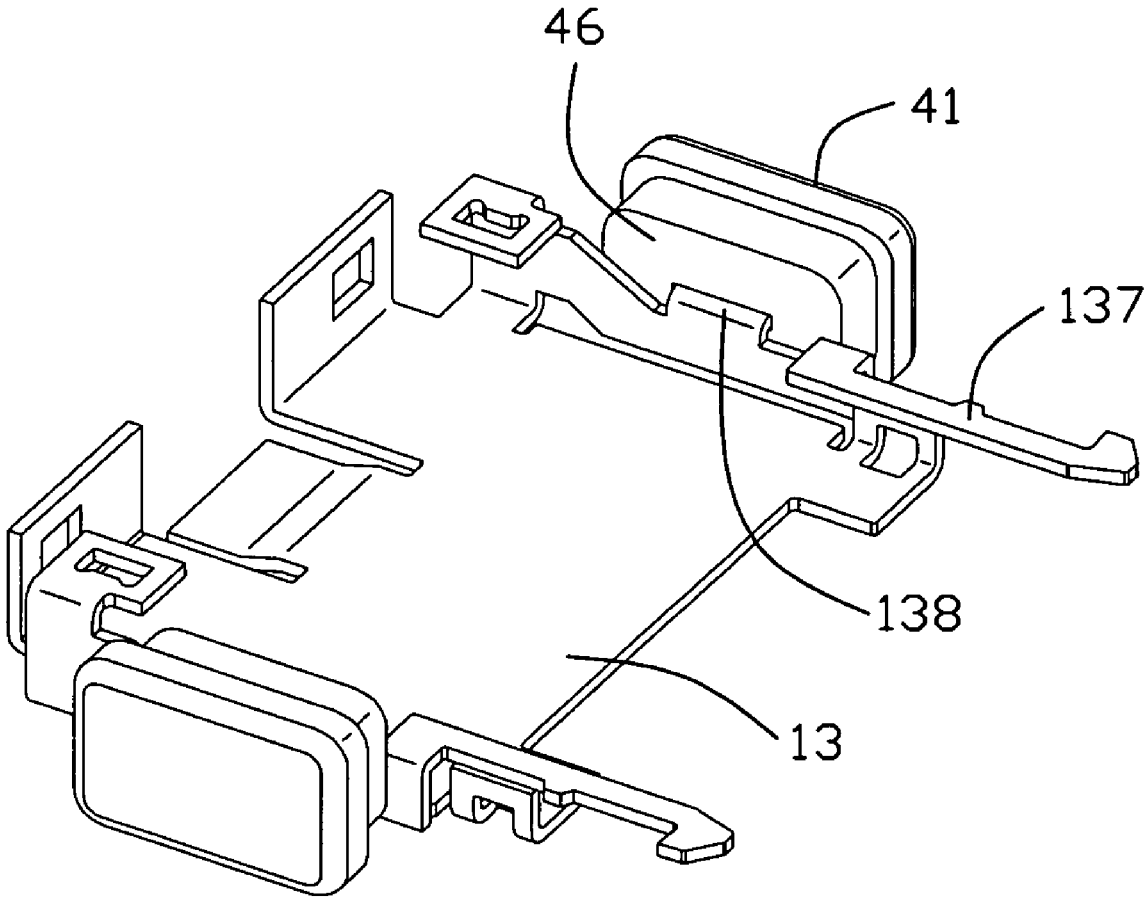
FIG. 8 is an assembled perspective view of the press members and the second shell of FIG. 7.

Other embodiments of the present invention are introduced hereafter. As FIGS. 7 and 8 shown, each sidewall 132 of the shell defines a bend portion 138 extending outwards from the bottom edge thereof. The press member 4 comprises an operating portion 41 and a retaining portion 46 with a slot 45 corresponding the bend portion 138 in the center. The press member 4 retained in the sidewall 132 by the hooked engaging portion 139 at the free end of the bend portion 138 engaging with the slot 45. What's more, the bend portion 138 may retained in the slot 45 by adhesive. The retaining portion 46 also can make the latching arm 137 inwardly move to release the complementary connector while a force is exerted on the operating portion 41.

However, the disclosure is illustrative only, changes may be made in detail, especially in matter of shape, size, and arrangement of parts within the principles of the invention.

What is claimed is:

1. An electrical connector, comprising:

a connector member comprising an insulating housing, the housing providing a plurality of conductive terminals therein, comprising a base portion and a mating portion extending forward from the base portion and a plurality of receiving grooves; the base portion defines a protrusion at each end thereof and an engaging portion on the top surface of the base portion; the engaging portion comprises a protrude portion and two recesses at one side of the protrude portion;

an insulative coat defining a receiving cavity with an opening to receive the base portion of the connector member and the retaining member; a pair of through holes provided at opposite sides of the receiving cavity with a stopper in each sidewall, and the mating portion extending out of the opening; the cavity comprises a first portion and a smaller second portion with different size to define two step faces, which are provided to encounter outside block portions and the rear portion of the retaining member to prevent the retaining member from further entering into the cavity;

a pair of shells comprising retaining portions and are assembled into the insulating coat;

a pair of latching members received in the receiving cavity with a front hook portion extending out of the opening; and a pair of press members comprises an operating portion, two contacting portions extending inward from opposite ends of the operating portion, and two locking portions extending inward between the two contacting portions; the two locking portions are parallel to each other and each provides with a hook portion at the free end; the locking portion is longer than the contacting portion;

wherein the press members are assembled into the through holes and retained with a back portion of the latching member.

2. The electrical connector as described in claim 1, wherein the insulative coat is one single-piece.

3. The electrical connector as described in claim 1, wherein the base portion is retained in the retaining member and the shell is longer than the base portion of the housing.

4. The electrical connector as described in claim 1, wherein the electrical connector further comprises a cable connecting with the connector member, the insulative coat comprises a cable outlet to let the cable pass through.

5. The electrical connector as described in claim 1, wherein the connector member further comprises the shell with two sidewall, each sidewall defines a latching arm extending forward from a front end thereof and a bend portion extending outwards from the bottom edge to retain with the press member.

6. The electrical connector as described in claim 5, wherein the press member defines a slot corresponding the bend portion, the press member retained in the sidewall by the bend portion engaging with the slot.

7. The electrical connector as described in claim 1, wherein the connector member further comprises the shell with two sidewalls, each sidewall defines a latching arm extending forward from a front end thereof and a retaining portion to retain with the press member.

8. The electrical connector as described in claim 7, wherein the mating portion is thinner than the base portion.

9. The electrical connector as described in claim 7, wherein the retaining portion is provided with a hole, the press member comprises two locking portions retained into the hole.

10. The electrical connector as described in claim 9, wherein the retaining member encloses a front portion of the housing so as to limit outward lateral movement of the latches.

11. An electrical connector comprising:

a connector member comprising an insulating housing, the housing providing a plurality of conductive terminals therein, comprising a base portion and a mating portion extending forward from the base portion and a plurality of receiving grooves; the base portion defines a protrusion at each end thereof and an engaging portion on the top surface of the base portion the engaging portion comprises a protrude portion and two recesses at one side of the protrude portion;

a coat overmolded upon a rear portion of the housing; the coat defining a receiving cavity with an opening to receive the base portion of the connector member and the retaining member; a pair of through holes provided at opposite sides of the receiving cavity with a stopper in each sidewall, and the mating portion extending out of the opening; the cavity comprises a first portion and a smaller second portion with different size to define two step faces, which are provided to encounter outside block portions and the rear portion of the retaining member to prevent the retaining member from further entering into the cavity;

a pair of shells comprising retaining portions and are assembled into the insulating coat;

a pair of latching members received in the receiving cavity with a front hook portion extending out of the opening; and a pair of press members comprises an operating portion, two contacting portions extending inward from opposite ends of the operating portion, and two locking portions extending inward between the two contacting portions; the two locking portions are parallel to each other and each provides with a hook portion at the free end; the locking portion is longer than the contacting portion;

wherein the press members are assembled into the through holes and retained with a back portion of the latching member.

12. The electrical connector as claimed in claim 11, wherein the retaining member encloses a front portion of the housing so as to limit outward lateral movement of the latches.

* * * * *